US010594051B2

(12) United States Patent
Zhang et al.

(10) Patent No.: US 10,594,051 B2
(45) Date of Patent: Mar. 17, 2020

(54) WIRE TO WIRE CONNECTOR

(71) Applicant: Tyco Electronics (Shanghai) Co. Ltd., Shanghai (CN)

(72) Inventors: Wei Zhang, Shanghai (CN); Ming Shi, Shanghai (CN); Xiaozhi Fu, Shanghai (CN); Dingbing Fan, Shanghai (CN); Hongtao Jiang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/240,011

(22) Filed: Jan. 4, 2019

(65) Prior Publication Data

US 2019/0214746 A1 Jul. 11, 2019

(30) Foreign Application Priority Data

Jan. 5, 2018 (CN) ..... 2018 1 0010597

(51) Int. Cl.

| | |
|---|---|
| ***H01R 11/20*** | (2006.01) |
| ***H01R 4/48*** | (2006.01) |
| ***H01R 13/52*** | (2006.01) |
| ***H01R 13/504*** | (2006.01) |
| ***H01R 43/00*** | (2006.01) |
| ***H01R 13/50*** | (2006.01) |
| *H01R 107/00* | (2006.01) |

(52) U.S. Cl.

CPC ..... *H01R 4/4818* (2013.01); *H01R 13/50* (2013.01); *H01R 13/504* (2013.01); *H01R 13/5208* (2013.01); *H01R 43/005* (2013.01); *H01R 2107/00* (2013.01)

(58) Field of Classification Search

CPC .... H01R 4/4818; H01R 13/50; H01R 43/005; H01R 13/5208; H01R 13/504; H01R 2107/00

USPC ..... 439/438, 439

See application file for complete search history.

(56) References Cited

U.S. PATENT DOCUMENTS 4,084,876 A * 4/1978 Dinger ..... H01R 4/4818 439/439
4,673,233 A * 6/1987 Hertelendy ..... H01R 4/5016 439/439
4,952,167 A * 8/1990 Hertelendy ..... H01R 4/2404 439/395

(Continued)

*Primary Examiner* — Abdullah A Riyami
*Assistant Examiner* — Nelson R. Burgos-Guntin
(74) *Attorney, Agent, or Firm* — Barley Snyder

(57) ABSTRACT

A wire to wire connector comprises an insulation housing having a receiving passage extending in an insertion direction of a first wire or a second wire, an integral conductive terminal disposed in the receiving passage and adapted to electrically connect the first wire and the second wire, and a pair of seal members. The receiving passage has a first insertion port and a second insertion port, the first wire is inserted into the receiving passage through the first insertion port and the second wire is inserted into the receiving passage through the second insertion port. The pair of seal members are respectively mounted in the first insertion port and the second insertion port and each have a passageway through which the first wire or the second wire extends. The seal members seal with the first wire and the second wire to prevent moisture from entering the receiving passage.

20 Claims, 4 Drawing Sheets

(56) References Cited

U.S. PATENT DOCUMENTS

| | | | | |
|---|---|---|---|---|
| 7,794,268 | B2 * | 9/2010 | Breen, IV | H01R 4/22<br>439/439 |
| 7,799,996 | B2 * | 9/2010 | Tamm | H01R 4/52<br>174/88 R |
| 8,262,405 | B1 * | 9/2012 | Bishop | H01R 4/4845<br>439/439 |
| 9,368,906 | B2 * | 6/2016 | Endo | H01R 13/05 |
| 9,450,316 | B2 * | 9/2016 | Diop | H01R 4/5075 |
| 9,608,362 | B2 * | 3/2017 | Jelak | B29C 45/03 |

* cited by examiner

WIRE TO WIRE CONNECTOR

CROSS-REFERENCE TO RELATED APPLICATION

This application claims the benefit of the filing date under 35 U.S.C. § 119(a)-(d) of Chinese Patent Application No. 201810010597.6, filed on Jan. 5, 2018.

FIELD OF THE INVENTION

The present invention relates to a connector and, more particularly, to a wire to wire connector.

BACKGROUND

In electronic devices such as a lighting lamp, a refrigerator, a washing machine, etc., two cables are often electrically connected using a wire to wire connector. The connector includes an insulation housing and a conductive terminal disposed within the insulation housing. During the connection of the cables to the connector, sheaths of the cables are peeled off to expose wires, and the wires are inserted and electrically connected to the conductive terminals of the connector.

In the electronic device, and particularly in a lighting device, an integral connector is required for rapid assembly and reduced construction cost. A connector including an integral conductive terminal, which is formed of a single metal plate, is commonly used. The two wires are respectively inserted into the insulation housing from insertion ports of the insulation housing, and two conductors are electrically connected to the integral terminal by insertion into the conductive terminal. However, there is no seal between the wire and the insertion port, and when the connector is used in a humid environment, foreign impurities such as moisture or dust are apt to easily enter an interior of the insulation housing through the insertion port, adversely influencing the electrical performance of the connector.

SUMMARY

A wire to wire connector comprises an insulation housing having a receiving passage extending in an insertion direction of a first wire or a second wire, an integral conductive terminal disposed in the receiving passage and adapted to electrically connect the first wire and the second wire, and a pair of seal members. The receiving passage has a first insertion port and a second insertion port, the first wire is inserted into the receiving passage through the first insertion port and the second wire is inserted into the receiving passage through the second insertion port. The pair of seal members are respectively mounted in the first insertion port and the second insertion port and each have a passageway through which the first wire or the second wire extends. The seal members seal with the first wire and the second wire to prevent moisture from entering the receiving passage.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
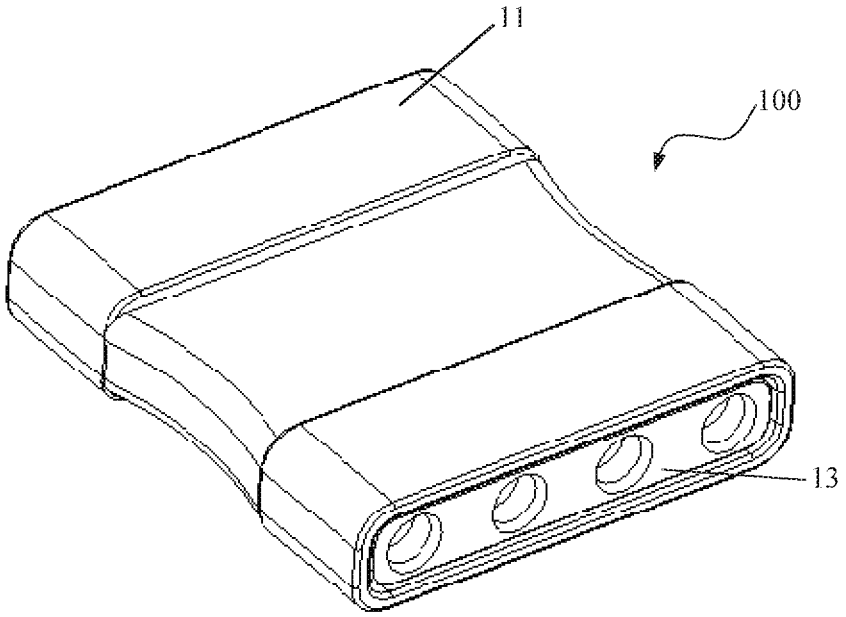
FIG. 1 is a perspective view of a wire to wire connector according to an embodiment.
Figure 2:
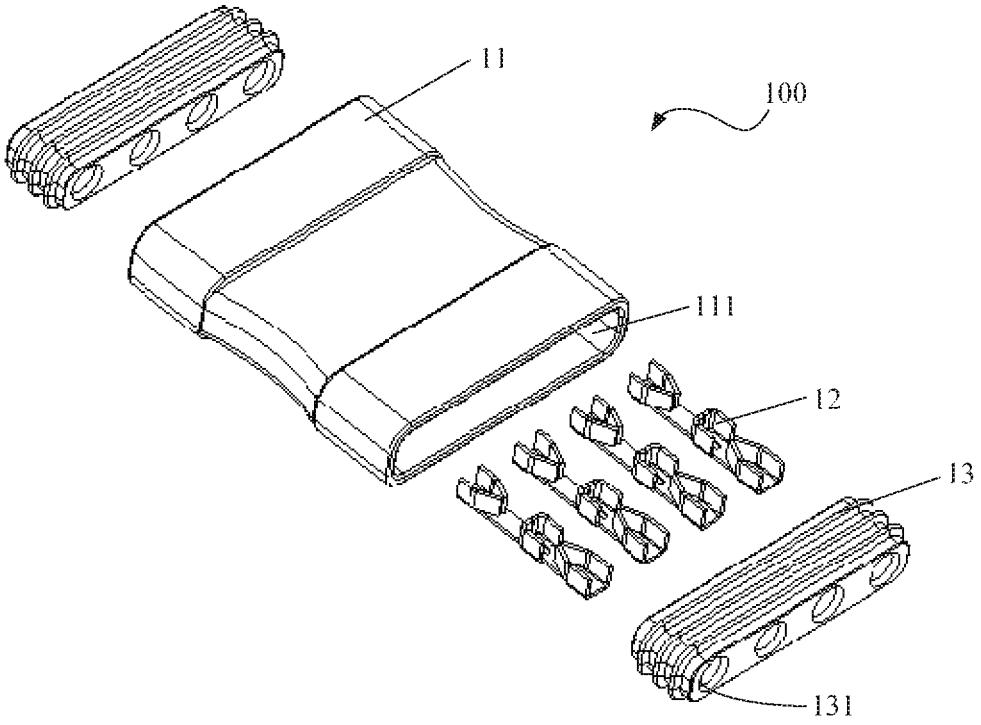
FIG. 2 is an exploded perspective view of the connector.
Figure 3:
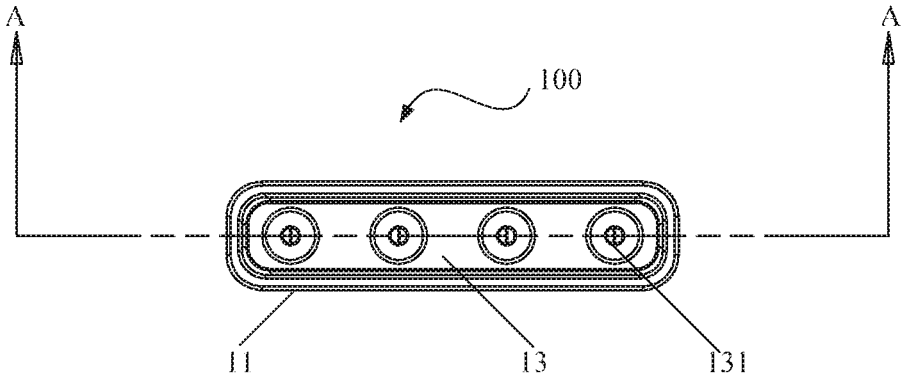
FIG. 3 is an end view of the connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A wire to wire connector 100 according to an embodiment is shown in FIGS. 1-4. The connector 100 is adapted to connect a first wire and a second wire. The connector 100 comprises an insulation housing 11, an integral conductive terminal 12, and two seal members 13.

The insulation housing 11, shown in FIGS. 1-4, is formed of a plastic material and has a receiving passage 111 extending through the insulation housing 11 in an insertion direction of the first wire or the second wire. Opposites ends of the receiving passage 111 have a first insertion port 113 and a second insertion port 114; the first wire is inserted into the receiving passage 111 through the first insertion port 113 and the second wire is inserted into the receiving passage 111 through the second insertion port 114.

The integral conductive terminal 12, shown in FIGS. 2 and 4-6, is formed of a single metal plate, for example a copper plate, and is received in the receiving passage 111 in the housing 11. The integral conductive terminal 12 is adapted to electrically connect the first and the second wires respectively inserted into the receiving passage 111.

The two seal members 13, shown in FIGS. 1-4, are made of rubber and are respectively mounted in the first insertion port 113 and the second insertion port 114. Each of the two seal members 13 has a passageway 131 through which the first wire or the second wire extends to prevent foreign moisture or dust from entering the receiving passage 111 through the first insertion port 113 or the second insertion port 114. In the connector 100, the seal members 13 in the first insertion portion 113 and the second insertion port 114 seal with the first wire and the second wire to prevent foreign moisture or dust from entering the receiving passage 111, avoiding an adverse effect on the connector 100.

In the embodiment shown in FIGS. 1-4, the connector 100 includes four integral conductive terminals 12 and four receiving passages 111 and is capable of connecting four first wires with four second wires. In other embodiments, the connector 100 may have any number, such as two, three, five, or six, of conductive terminals 12 and a corresponding number of receiving passages 111.

Figure 4:
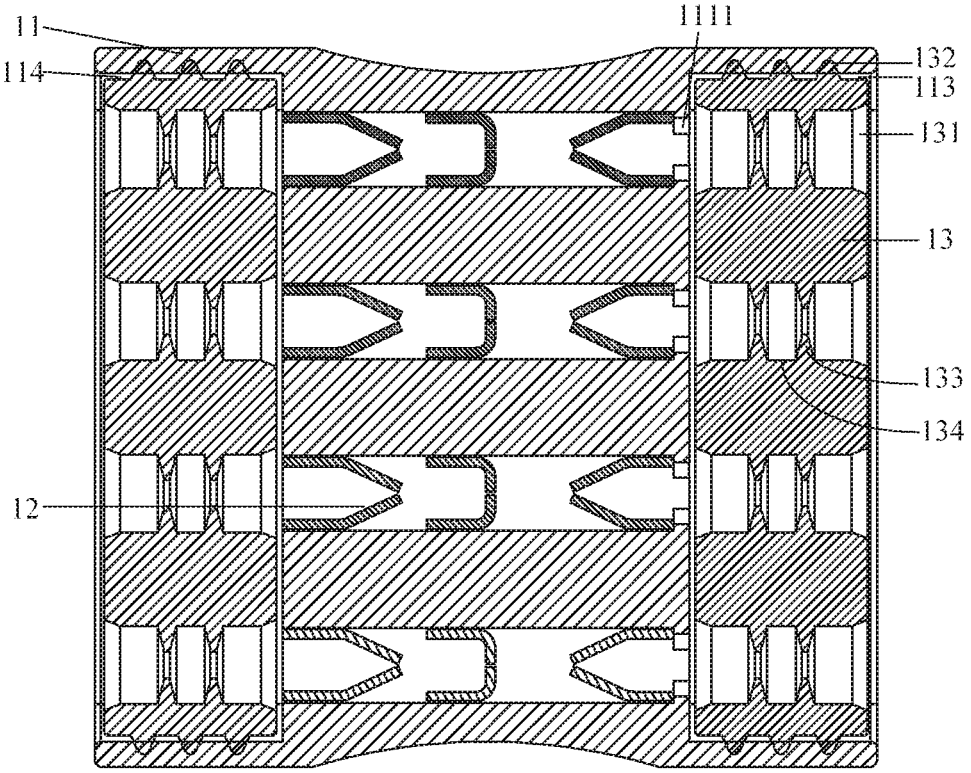
FIG. 4 is a sectional top view of the connector taken along line A-A of FIG. 3.

As shown in FIG. 4, an exterior surface of the seal member 13 has a projection 132. An interior surface of the first insertion port 113 and the second insertion port 114 has a groove receiving the projection 132 to improve a sealing and engagement between the seal member 13 and the receiving passage 111. In the shown embodiment, the projection 132 extends circumferentially around the exterior surface of the seal member 13 and the groove extends circumferentially around the interior surface of the first insertion port 113 and the second insertion port 114. In another embodiment, the exterior surface of the seal member 13 has a groove and an interior surface of the first insertion port 113 and the second insertion port 114 has a projection. In another embodiment, the exterior surface of the seal member 13 has the projection 132 and the interior surface of the first insertion port 113 and the second insertion port 114 is a flat surface. In this embodiment, when the seal member 13 is inserted into the first insertion port 113 or the second insertion port 114, the projection 132 is pressed and abuts against the flat surface of the first insertion port 113 and the second insertion port 114, preventing foreign moisture from entering the receiving passage 111.

As shown in FIG. 4, each passageway 131 of the seal member 13 has a pair of seal rings 133 projecting radially inward from an interior surface of the passageway 131 with a receiving groove 134 disposed between two adjacent seal rings 133. A minimum inner diameter of the seal ring 133 is smaller than an outer diameter of the first or second wire, and a maximum inner diameter of the receiving groove 134 is larger than the outer diameter of the first or second wire. In this way, the seal ring 133 maintains a good seal with the wire and impurities such as moisture or dust entering the outer seal ring 133 accumulate in the receiving groove 134 and do not further enter the receiving passage 111.

As shown in FIGS. 2 and 4-6, each of the integral conductive terminals 12 has a first end 126 and a second end 127 opposite the first end 126. Each of the conductive terminals 12 includes a flat body portion 121 extending in the insertion direction, a first clamping portion 122 arranged at the first end 126 of the body portion 121, and a second clamping portion 123 arranged at the second end 127 of the body portion 121. The first clamping portion 122 is configured to clamp the first wire inserted through the first insertion port 113, and the second clamping portion 123 is configured to clamp the second wire inserted through the second insertion port 114, such that the first and second wires are electrically connected.

Figure 5:
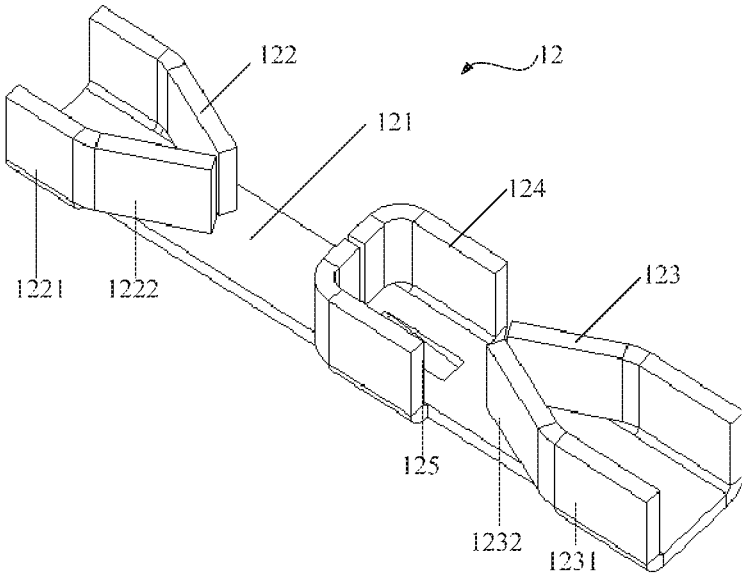
FIG. 5 is a perspective view of a conductive terminal of the connector.
Figure 6:
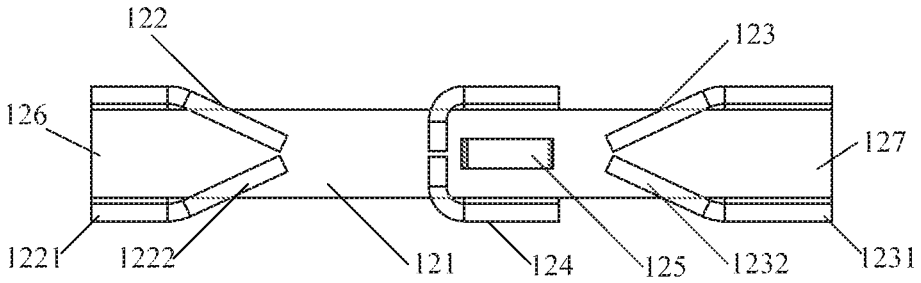
FIG. 6 is a top view of the conductive terminal.

The first clamping portion 122, as shown in FIGS. 5 and 6, includes a pair of guiding walls 1221 facing each other on both sides of the body portion 121 and extending perpendicular to the body portion 121 to guide a conductor of the inserted first wire, and a pair of clamping arms 1222 extending obliquely toward each other from the guiding wall 1221 toward the second end 127 to clamp the conductor of the inserted first wire. An end of the clamping arm 1222 forms a sharp edge to partially penetrate the wire, increasing the retention for the wire. The second clamping portion 123 includes a pair of guiding walls 1231 facing each other on both sides of the body portion 121 and extending perpendicular to the body portion 121 to guide a conductor of the inserted second wire, and a pair of clamping arms 1232 extending obliquely with respect to each other from the guiding wall 1231 toward the first end 126 to clamp the conductor of the inserted second wire. An end of the clamping arm 1232 forms a sharp edge to partially penetrate the wire, increasing the retention for the wire.

As shown in FIGS. 5 and 6, each conductive terminal 12 includes a stop 124 disposed on the body portion 121 between the first clamping portion 122 and the second clamping portion 123. The stop 124 is adapted to limit a length by which the first wire and the second wire are inserted into the receiving passage 111. In FIGS. 5 and 6, the stop 124 is disposed proximate the second clamping portion 123. In another embodiment, the stop 124 is disposed proximate the first clamping portion 122.

As shown in FIG. 4, a protrusion 1111 is provided at a position in the receiving passage 111 close to the first insertion port 113, and the first end 126 of the conductive terminal 12 abuts against the protrusion 1111 to prevent further insertion of the conductive terminals 12.

As shown in FIGS. 5 and 6, a surface of the body portion 121 of the conductive terminal 12 opposite to the second clamping portion 123 has a locking portion 125 extending obliquely toward the second insertion port 114. The insulation housing 11 has a locking hole. The locking portion 125 is partially engaged into the locking hole to prevent the conductive terminal 12 from being detached from the receiving passage 111.

When the first wire and the second wire are inserted into the receiving passage 111 through the first insertion port 113 and the second insertion port 114 of the insulation housing 11, respectively, the first clamping arm 1222 and the second clamping arm 1232 penetrate the conductors of the two wires to clamp the first wire and the second wire. The clamping arms 1222, 1232 form an electrical connection between the wires and the conductive terminal 12, electrically connecting the first wire and the second wire. Further, because two seal members 13 are provided at the first insertion port 113 and the second insertion port 114 at both ends of the insulation housing 11, the moisture or dust is blocked by the seal member 13, or accumulated in the receiving groove 134 of the seal member 13, so as to ensure that moisture or dust does not enter the receiving passage 111 through the first insertion port 113 or the second insertion port 114.

What is claimed is:

1. A wire to wire connector, comprising:

an insulation housing having a receiving passage extending through the insulation housing in an insertion direction of a first wire or a second wire, the receiving passage having a first insertion port at a first end and a second insertion port at a second end opposite the first end, the first wire is inserted into the receiving passage through the first insertion port and the second wire is inserted into the receiving passage through the second insertion port;

an integral conductive terminal disposed in the receiving passage and adapted to electrically connect the first wire and the second wire, the integral conductive terminal having:

a body portion extending in the insertion direction;

a first clamping portion disposed at a first end of the body portion and configured to clamp the first wire inserted through the first insertion port; and a second clamping portion disposed at a second end of the body portion opposite the first end of the body portion and configured to clamp the second wire inserted through the second insertion port to electrically connect the first wire and the second wire; and a pair of seal members respectively mounted in the first insertion port and the second insertion port, each of the seal members having a passageway through which the first wire or the second wire extends, the seal members sealing with the first wire and the second wire to prevent moisture from entering the receiving passage through the first insertion port and the second insertion port.

2. The wire to wire connector of claim 1, wherein the integral conductive terminal includes a stop disposed on the body portion between the first clamping portion and the second clamping portion.

3. The wire to wire connector of claim 2, wherein the stop is adapted to limit a length by which the first wire and/or the second wire is inserted into the receiving passage.

4. The wire to wire connector of claim 1, wherein the first clamping portion and the second clamping portion each have a pair of guiding walls facing each other on opposite sides of the body portion and extending perpendicular to the body portion.

5. The wire to wire connector of claim 4, wherein the first clamping portion and the second clamping portion each have a pair of clamping arms extending obliquely toward each other from a side of each of the guiding walls located downstream in the insertion direction and clamping a conductor of the first wire or the second wire.

6. The wire to wire connector of claim 5, wherein an end of each of the clamping arms has a sharp edge.

7. The wire to wire connector of claim 5, wherein the receiving passage has a protrusion disposed adjacent to the first insertion port.

8. The wire to wire connector of claim 7, wherein a first end of the integral conductive terminal abuts against the protrusion to limit insertion of the integral conductive terminal.

9. The wire to wire connector of claim 8, wherein the body portion has a locking portion extending obliquely toward the second insertion port and disposed opposite the second clamping portion.

10. The wire to wire connector of claim 9, wherein the insulation housing has a locking hole engaging the locking portion to prevent the integral conductive terminal from being detached from the receiving passage.

11. The wire to wire connector of claim 1, wherein an exterior surface of each of the seal members has a projection or a groove extending circumferentially around the exterior surface of the seal member.

12. The wire to wire connector of claim 11, wherein an interior surface of the first insertion port or the second insertion port has a groove or a projection extending circumferentially around the interior surface of the first insertion portion or the second insertion port.

13. The wire to wire connector of claim 12, wherein the projection or the groove of the seal member engages the groove or the projection of the first insertion port or the second insertion port.

14. The wire to wire connector of claim 1, wherein the passageway of each of the seal members has a pair of seal rings projecting radially inward from an interior surface of the passageway and a receiving groove disposed between the pair of seal rings.

15. The wire to wire connector of claim 14, wherein a minimum inner diameter of each of the seal rings is smaller than an outer diameter of the first wire and the second wire, and a maximum inner diameter of the receiving groove is larger than an outer diameter of the first wire and the second wire.

16. A wire to wire connector, comprising:

an insulation housing having a receiving passage extending through the insulation housing in an insertion direction of a first wire or a second wire, the receiving passage having a first insertion port at a first end and a second insertion port at a second end opposite the first end, the first wire is inserted into the receiving passage through the first insertion port and the second wire is inserted into the receiving passage through the second insertion port;

an integral conductive terminal disposed in the receiving passage and adapted to electrically connect the first wire and the second wire; and a pair of seal members respectively mounted in the first insertion port and the second insertion port, each of the seal members having a passageway through which the first wire or the second wire extends, the seal members sealing with the first wire and the second wire to prevent moisture from entering the receiving passage through the first insertion port and the second insertion port, an exterior surface of each of the seal members includes a projection or a groove extending circumferentially around the exterior surface of the seal member.

17. The wire to wire connector of claim 16, wherein an interior surface of the first insertion port or the second insertion port has a groove or a projection extending circumferentially around the interior surface of the first insertion portion or the second insertion port.

18. The wire to wire connector of claim 17, wherein the projection or the groove of the seal member engages the groove or the projection of the first insertion port or the second insertion port.

19. A wire to wire connector, comprising:

an insulation housing having a receiving passage extending through the insulation housing in an insertion direction of a first wire or a second wire, the receiving passage having a first insertion port at a first end and a second insertion port at a second end opposite the first end, the first wire is inserted into the receiving passage through the first insertion port and the second wire is inserted into the receiving passage through the second insertion port;

an integral conductive terminal disposed in the receiving passage and adapted to electrically connect the first wire and the second wire; and a pair of seal members respectively mounted in the first insertion port and the second insertion port, each of the seal members having a passageway through which the first wire or the second wire extends, the seal members sealing with the first wire and the second wire to prevent moisture from entering the receiving passage through the first insertion port and the second insertion port, the passageway of each of the seal members has a pair of seal rings projecting radially inward from an interior surface of the passageway and a receiving groove disposed between the pair of seal rings.

20. The wire to wire connector of claim 19, wherein a minimum inner diameter of each of the seal rings is smaller than an outer diameter of the first wire and the second wire, and a maximum inner diameter of the receiving groove is larger than an outer diameter of the first wire and the second wire.

* * * * *